US011021825B2

(12) United States Patent
Dedow et al.

(10) Patent No.: US 11,021,825 B2
(45) Date of Patent: Jun. 1, 2021

(54) WASHING MACHINE APPLIANCE WITH LOCATION DETECTION OF IMBALANCED LOADS

(71) Applicant: Haier US Appliance Solutions, Inc., Wilmington, DE (US)

(72) Inventors: Gregory Allen Dedow, Louisville, KY (US); Paul Owen Davis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 288 days.

(21) Appl. No.: 15/950,249

(22) Filed: Apr. 11, 2018

(65) Prior Publication Data

US 2019/0316287 A1 Oct. 17, 2019

(51) Int. Cl.

| | |
|---|---|
| ***D06F 34/16*** | (2020.01) |
| ***D06F 37/20*** | (2006.01) |
| *D06F 37/22* | (2006.01) |

(52) U.S. Cl.

CPC ..... *D06F 34/16* (2020.02); *D06F 37/203* (2013.01); *D06F 37/225* (2013.01)

(58) Field of Classification Search

CPC ... D06F 37/203; D06F 37/225; D06F 2222/00
See application file for complete search history.

(56) References Cited

U.S. PATENT DOCUMENTS 6,715,175 B2 * 4/2004 Ciancimino ..... D06F 33/00 8/159
7,581,272 B2 9/2009 Xie et al.
2006/0242768 A1 11/2006 Zhang et al.
2007/0039104 A1 * 2/2007 Lee ..... D06F 37/203 8/158
2007/0266504 A1 * 11/2007 Xie ..... D06F 37/203 8/158
2012/0278996 A1 * 11/2012 Park ..... D06F 37/225 8/137
2016/0289882 A1 * 10/2016 Song ..... D06F 37/04

FOREIGN PATENT DOCUMENTS

| | | | | |
|---|---|---|---|---|
| DE | 102009028508 | A1 * | 2/2011 | ..... D06F 37/203 |
| EP | 1154064 | B1 | 4/2005 | |
| EP | 2050856 | A1 | 4/2009 | |
| JP | 2009028421 | A * | 2/2009 | |
| JP | 4257312 | B2 | 4/2009 | |
| JP | 4580813 | B2 * | 11/2010 | |
| WO | WO2014199627 | A1 | 12/2014 | |

* cited by examiner

*Primary Examiner* — Kevin G Lee

(74) *Attorney, Agent, or Firm* — Dority & Manning, P.A.

(57) ABSTRACT

A washing machine appliance configured to detect a location of an imbalanced load is provided. The washing machine appliance utilizes the displacement or a component of the displacement of a tub of the washing machine appliance to determine the location of an out-of-balance load. In particular, the washing machine compares the displacement or component of the displacement of the tub at a first point with the displacement of the tub at a second point that is positioned forward of the first point. By comparing the displacement or components of the displacement of the tub at these two points, the location of the imbalanced load may be determined. Methods for determining imbalanced loads are also provided.

16 Claims, 11 Drawing Sheets

WASHING MACHINE APPLIANCE WITH LOCATION DETECTION OF IMBALANCED LOADS

FIELD OF THE INVENTION

The present disclosure relates generally to washing machine appliances and more particularly to washing machine appliances configured to detect a location of an imbalanced load.

BACKGROUND OF THE INVENTION

Washing machine appliances generally include a drum or basket rotatably mounted within a tub of a cabinet. The basket defines a wash chamber for receiving articles for washing. During operation, wash fluid is directed into the tub and onto articles within the wash chamber. A motor can rotate the basket at various speeds to agitate articles within the wash chamber in wash fluid, to wring wash fluid from articles within the wash chamber, etc.

In particular, after the articles of clothing have been washed, the washing machine can drain the wash fluid and then spin the basket at a high speed in order to relieve the articles of clothing of remaining moisture and fluid. This process is generally known as a spin cycle or a spin out process. In certain circumstances, prior to a spin cycle, the load in the washing machine can become imbalanced. In particular, the articles of clothing can become disproportionately distributed to a single location and form an out-of-balance mass or load. For example, the articles of clothing can bunch together at a single location in the rear of the tub. An out-of-balance mass can cause a number of problems if it remains uncorrected during the spin cycle. Specifically, the imbalanced mass can alter the center of mass of the basket and load as a whole so that the center of mass is no longer aligned with a shaft center of the washing machine. Rotating the basket at high speeds in such a condition can cause undesirable vibration, noise, or damage to system components.

Conventionally, washing machine appliances have been configured to detect such imbalanced masses, as well as some of the characteristics of the imbalanced mass, such as e.g., the mass or size of the imbalanced mass and the location of the imbalanced mass. Detecting the location of an imbalanced mass has conventionally been determined by utilizing various inputs, such as motor speed and/or basket speed. However, use of such inputs to determine the location of an imbalanced load has provided less than ideal estimates of the location of such imbalanced masses and use of such inputs require that the motor be operated in order to detect the location of an imbalanced load, which consumes energy.

Therefore, a washing machine appliance and methods for determining a location of an imbalanced load that address one or more of the challenges noted above would be useful.

BRIEF DESCRIPTION OF THE INVENTION

The present disclosure provides a washing machine appliance configured to detect a location of an imbalanced load. The washing machine appliance utilizes the displacement or a component of the displacement of a tub of the washing machine appliance to determine the location of an out-of-balance load. More particularly, the washing machine compares the displacement or a component of the displacement of the tub at a first point with the displacement of the tub at a second point that is positioned forward of the first point.

By comparing the displacement or component of the displacement of the tub at these two points, the location of the imbalanced load may be determined. Methods for determining such imbalanced loads are also provided. Additional aspects and advantages of the invention will be set forth in part in the following description, or may be apparent from the description, or may be learned through practice of the invention.

One aspect of the present disclosure is directed to a method for determining a location of an imbalanced load in a washing machine appliance. The washing machine appliance extending between a front and a rear and comprising a tub and a basket rotatably mounted within the tub, the tub defining a first point and a second point positioned forward of the first point, the first point positioned at a first origin and the second point positioned at a second origin when the washing machine appliance is in a resting state. The method includes ascertaining a first displacement of the first point relative to the first origin for a first time period. The method also includes ascertaining a second displacement of the second point relative to the second origin for the first time period. Further, the method includes determining the location of the imbalanced load for the first time period based at least in part on the first displacement and the second displacement.

In some implementations, the method includes generating a control action in response to the location of the imbalanced load.

Another aspect of the present disclosure is directed a horizontal axis washing machine appliance. The horizontal axis washing machine appliance includes a cabinet and a tub positioned within the cabinet and extending between a front and a rear, the tub defining a first point and a second point positioned forward of the first point, the first point positioned at a first origin and the second point positioned at a second origin when the horizontal axis washing machine appliance is in a resting state. Further, the horizontal axis washing machine appliance includes a basket rotatably mounted within the tub, the basket defining a wash chamber for receipt of articles for washing. The horizontal axis washing machine appliance also includes a displacement measurement unit attached to the tub and a controller in operative communication with the displacement measurement unit. The controller is configured to: receive an input generated by the displacement measurement unit that is indicative of a displacement of the tub relative to its position in the resting state for a first time period; ascertain a first displacement of the first point relative to the first origin for the first time period based at least in part on the input; ascertain a second displacement of the second point relative to the second origin for the first time period based at least in part on the input; determine the location of the imbalanced load for the first time period based at least in part on the first displacement and the second displacement; and generate a control action in response to the location of the imbalanced load.

Yet another aspect of the present disclosure is directed to a method for determining a location of an imbalanced load in a washing machine appliance, the washing machine appliance extending between a front and a rear and comprising a tub and a basket rotatably mounted within the tub, the tub defining a first point and a second point positioned forward of the first point, the first point positioned at a first origin and the second point positioned at a second origin when the washing machine appliance is in a resting state. The method includes ascertaining a first distance between the first point and the first origin along a first direction for a first time period. The method also includes ascertaining a second distance between the second point and the second origin along the first direction for the first time period. In addition, the method includes determining the location of the imbalanced load for the first time period based at least in part on the first distance and the second distance. Moreover, the method includes generating a control action in response to the location of the imbalanced load.

In some implementations, the first direction is a lateral direction defined by washing machine appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
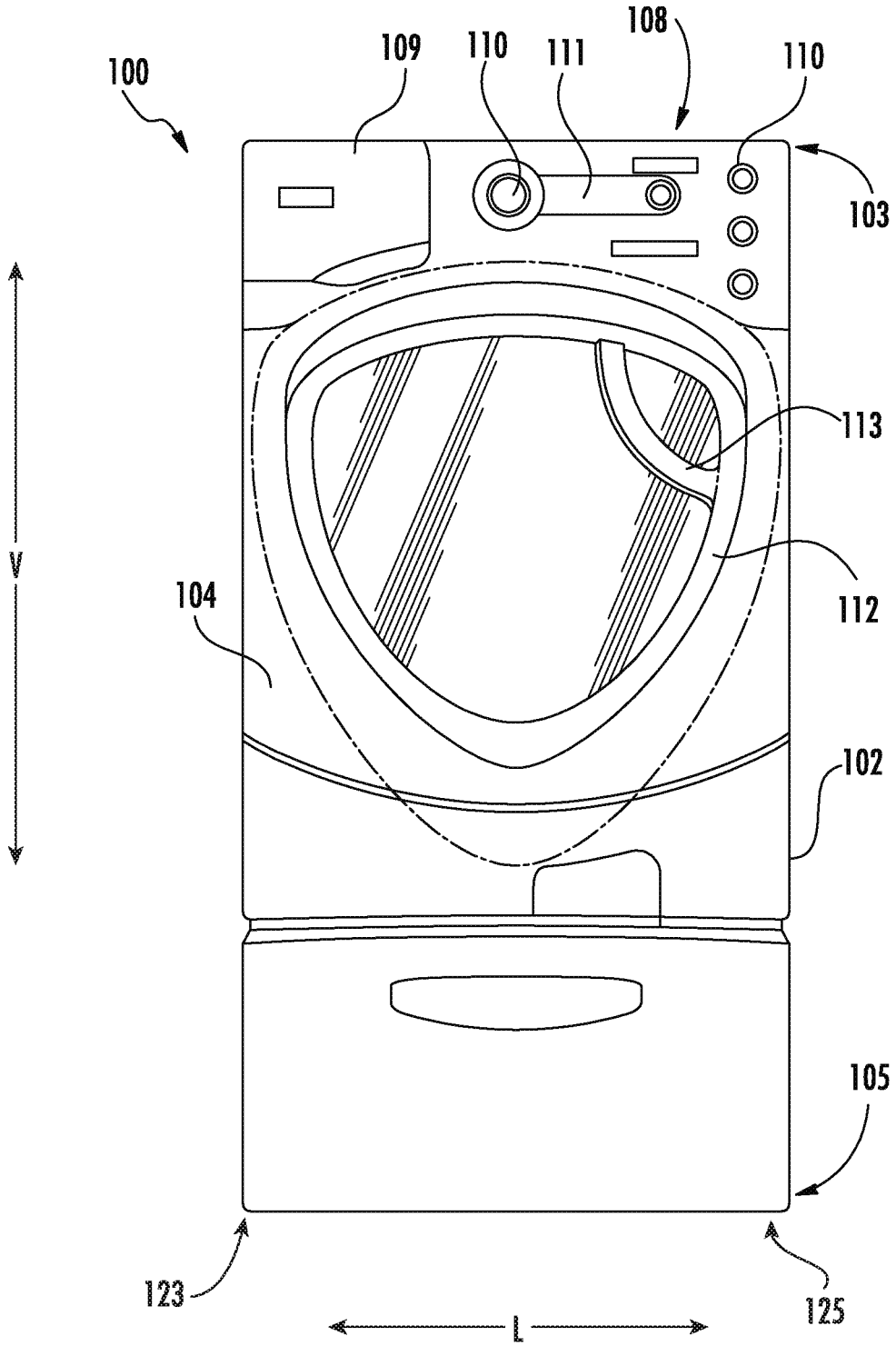
FIG. 1 depicts a front, elevation view of a washing machine appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
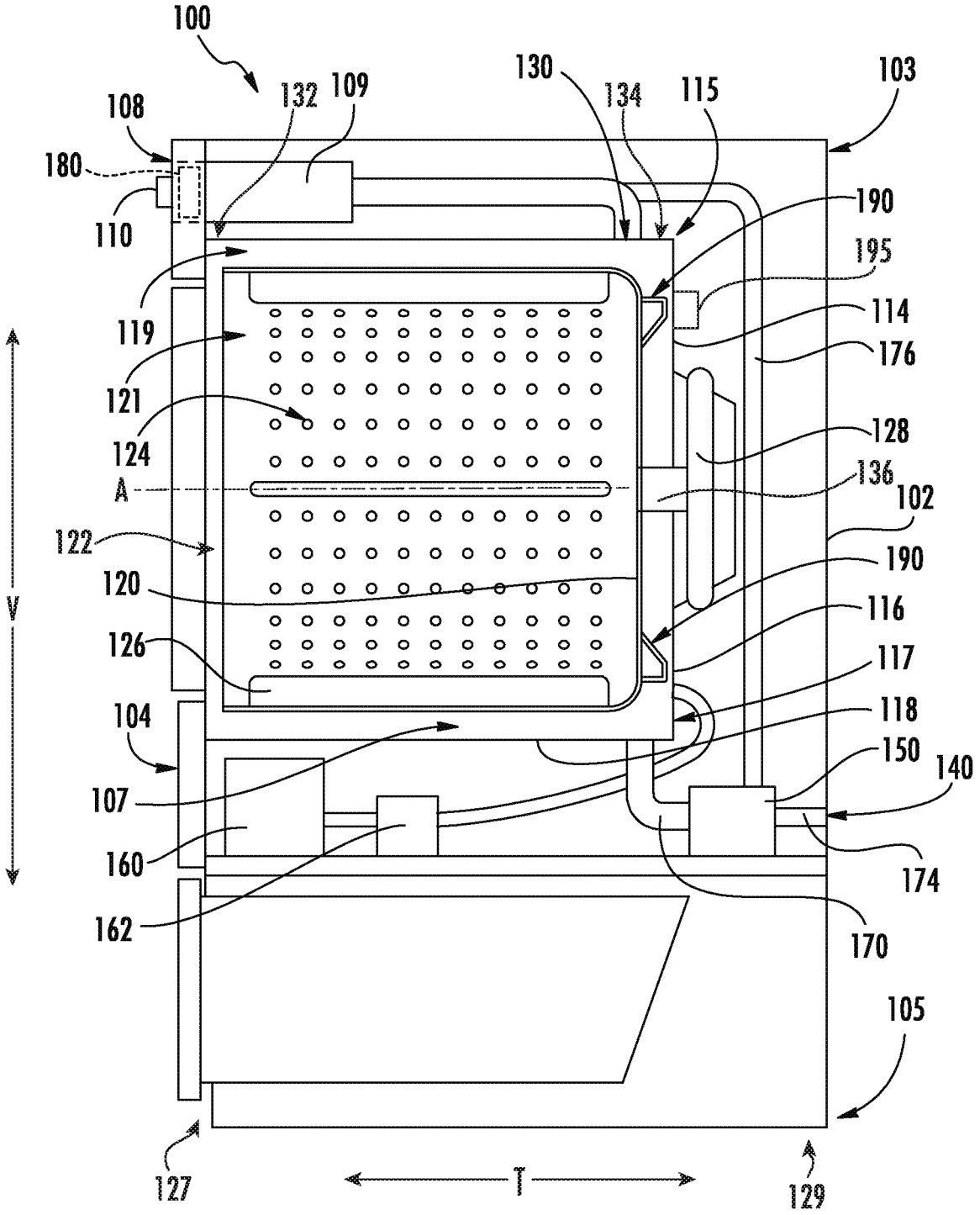
FIG. 2 depicts a side, section view of the exemplary washing machine appliance of FIG. 1.

FIG. 1 provides a front, elevation view of an exemplary horizontal axis washing machine appliance 100. FIG. 2 provides a side, section view of washing machine appliance 100. As shown in FIG. 1, washing machine appliance 100 includes a cabinet 102 that extends between a top portion 103 and a bottom portion 105, e.g., along a vertical direction V. Cabinet 102 also extends between a first side 123 and a second side 125, e.g., along a lateral direction L, and between a front 127 and a rear 129 (FIG. 2), e.g., along a transverse direction T. The vertical, lateral, and transverse directions V, L, T defined by washing machine appliance 100 are mutually perpendicular and together define an orthogonal direction system.

Cabinet 102 includes a front panel 104. A door 112 (FIG. 1) is mounted to front panel 104 and is rotatable about a hinge (not shown) between an open position facilitating access to a wash drum or basket 120 (FIG. 2) located within cabinet 102, and a closed position (shown in FIG. 1) hindering access to basket 120. A user may pull on a handle 113 in order to adjust door 112 (FIG. 1) between the open position and the closed position.

A control panel 108 including a plurality of input selectors 110 is coupled to front panel 104. Control panel 108 and input selectors 110 collectively form a user interface input for operator selection of machine cycles and features. For example, in one embodiment, a display 111 (FIG. 1) indicates selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of washing machine appliance 100. Washing fluid disposed within tub 114 may include at least one of water, fabric softener, bleach, and detergent. Tub 114 includes a back wall 116 and a sidewall 118 and also extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. In particular, a shaft 136 mechanically couples motor 128 with basket 120 and drivingly rotates basket 120 about a shaft or central axis A, e.g., during a spin cycle. Ribs 126 extend from basket 120 into wash chamber 121. Ribs 126 assist agitation of articles disposed within wash chamber 121 during operation of washing machine appliance 100. For example, ribs 126 may lift articles disposed in basket 120 during rotation of basket 120.

A drawer 109 is slidably mounted within front panel 104. Drawer 109 receives a fluid additive (e.g., detergent, fabric softener, bleach, or any other suitable liquid) and directs the fluid additive to wash fluid compartment 119 during operation of washing machine appliance 100. Additionally, a reservoir 160 is disposed within cabinet 102. Reservoir 160 is also configured for receipt of fluid additive for use during operation of washing machine appliance 100. Reservoir 160 is sized such that a volume of fluid additive sufficient for a plurality or multitude of wash cycles of washing machine appliance 100 may fill reservoir 160. Thus, for example, a user can fill reservoir 160 with fluid additive and operate washing machine appliance 100 for a plurality of wash cycles without refilling reservoir 160 with fluid additive. A reservoir pump 162 is configured for selective delivery of the fluid additive from reservoir 160 to tub 114.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in washing machine appliance 100 and can be placed according to any known or desirable configuration. For example, two balancing rings can be respectively placed at the front and back of basket 120.

As further depicted in FIG. 2, a displacement measurement unit 195 is shown attached to tub 114. In particular, for this embodiment, displacement measurement unit 195 is attached to backwall 116 of tub 114. In alternative embodiments, displacement measurement unit 195 may be attached to tub 114 in any other suitable location, such as e.g., to sidewall 118. Displacement measurement unit 195 is operatively configured to sense or measure the motion of tub 114 at a point during operation. For this embodiment, displacement measurement unit 195 includes an accelerometer and a gyroscope. Accordingly, displacement measurement unit 195 is configured to sense or measure the translational movement of tub 114 at a point (via the accelerometer) and the rotational movement of tub 114 at the point (via the gyroscope). In accordance with exemplary aspects of the present disclosure, displacement measurement unit 195 may generate a signal indicative of a displacement of the tub relative to its position in its resting state (i.e., a state in which there are no articles within basket 120 and basket 120 is not in motion). Such input signals may be routed to a controller, as will be explained further below, such that the location of an imbalanced mass or load may ultimately be determined.

Operation of washing machine appliance 100 is controlled by a processing device or controller 180 that is operatively coupled to control panel 108 for user manipulation to select washing machine cycles and features. In response to user manipulation of control panel 108, controller 180 operates the various components of washing machine appliance 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of washing machine appliance 100 may be in communication with controller 180 via one or more signal lines or shared communication busses.

Controller 180 is in operative communication with motor 128. Thus, controller 180 can selectively activate and operate motor 128, e.g., depending upon a wash cycle selected by a user of washing machine appliance 100. Controller 180 may also be configured for monitoring a power delivered to motor 128. As will be understood by those skilled in the art, power delivered to motor 128 can be measured or determined by controller 180 utilizing various methods. Further, controller 180 may further be configured for determining a current speed of motor 128 according to any known techniques. For example, a speed signal describing the current speed of the motor can be created and provided to controller 180 according to back electromotive force techniques or based on the output of one or more sensors or other components including, for example, an optical sensor or magnetic-based sensors such as hall effect sensors.

In addition, controller 180 is also in operative communication with displacement measurement unit 195. Accordingly, controller 180 may receive signal inputs from displacement measurement unit 195 indicative of the displacement of tub 114 during operation. Such inputs may be used, as noted above, to determine the location of an imbalanced load.

In an illustrative example of operation of washing machine appliance 100, laundry items are loaded into basket 120, and washing operation is initiated through operator manipulation of input selectors 110. Tub 114 is filled with water and detergent to form a wash fluid. One or more valves (not shown) can be actuated by controller 180 to provide for filling tub 114 to the appropriate level for the amount of articles being washed. Once tub 114 is properly filled with wash fluid, the contents of basket 120 are agitated with ribs 126 for cleansing of laundry items in basket 120.

After the agitation phase of the wash cycle is completed, tub 114 is drained. Laundry articles can then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well, including, for example, vertical axis washing machine appliances. Thus, the teachings of the present disclosure are not limited to use with washing machine appliance 100.

Figure 3:
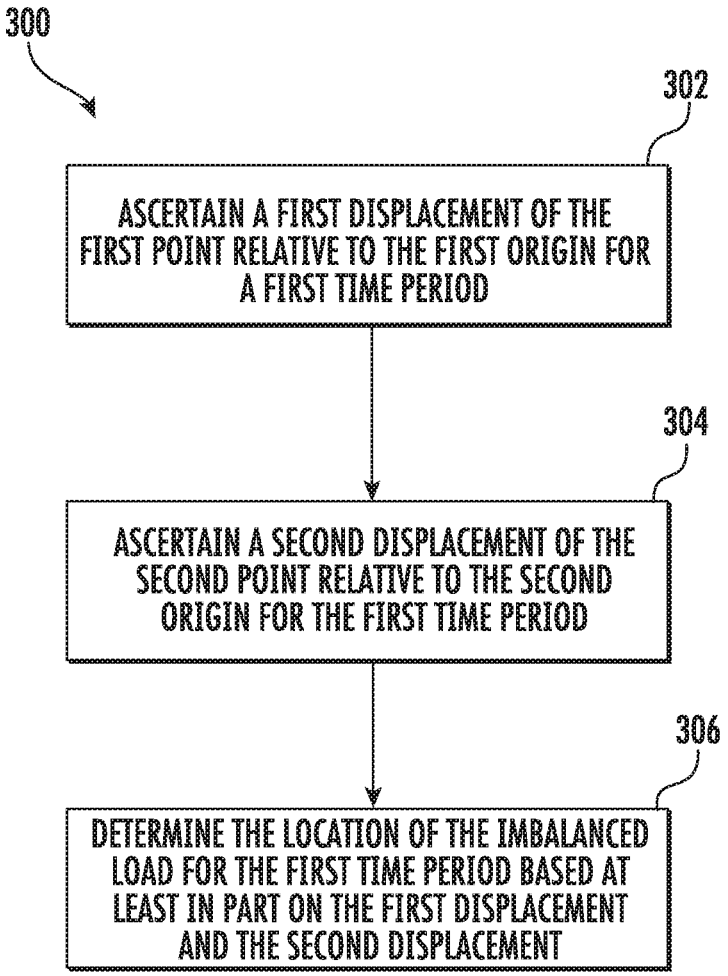
FIG. 3 provides a flow chart of an exemplary method for determining a location of an imbalanced load in a washing machine appliance according to an exemplary embodiment of the present disclosure.

FIG. 3 depicts an exemplary method (300) for determining a location of an imbalanced load in a washing machine appliance according to an exemplary embodiment of the present disclosure. Method (300) can be implemented using any suitable appliance, including for example, horizontal axis washing machine appliance 100 of FIGS. 1 and 2. Accordingly, to provide context to method (300), reference numerals utilized to describe the features of washing machine appliance 100 in FIGS. 1 and 2 will be used below.

In some exemplary implementations of method (300), washing machine appliance 100 extends between front 127 and rear 129 and includes tub 114 and basket 120 rotatably mounted within tub 114. Basket 120 is configured for receipt of articles for washing. Further, as will be explained further below, tub 114 defines a first point and a second point. The second point is positioned forward of the first point. For example, tub 114 may define the first point at a rear portion of tub 114 and tub 114 may define the second point at a front portion of tub 114. When washing machine appliance 100 is in a resting state (i.e., a state in which basket 120 is at rest without any articles within wash chamber 121 of basket 120), the first point is positioned at a first origin and the second point is positioned at a second origin. When washing machine appliance 100 is in an active state (i.e., there is a load within basket 120 and/or basket 120 is in motion), the displacement of the first point relative to the first origin and the displacement of the second point relative to the second origin are used to determine the relative motion of the tub at the first and second points, which in accordance with exemplary aspects of the present disclosure, may be used to determine the location of an imbalanced load within washing machine appliance 100.

At (302), method (300) includes ascertaining a first displacement of the first point relative to the first origin for a first time period. As will be appreciated, tub 114 may be displaced. For instance, when articles are placed within basket 120, tub 114 may be displaced from its position in the resting state due to the mass of the articles. In addition, when articles are placed within basket 120 and basket 120 is rotated about the central axis A, tub 114 may be displaced due to the mass of the articles within basket 120 and the rotation of basket 120. In ascertaining the displacement of the first point relative to the first origin, the displacement of tub 114 relative to its position in the resting state is determined at the first point. The first time period may be any suitable period of time. For instance, the first time period may be a time step of controller 180.

At (304), method (300) includes ascertaining a second displacement of the second point relative to the second origin for the first time period. In ascertaining the displacement of the second point relative to the second origin, the displacement of tub 114 relative to its position in the resting state is determined at the second point. An exemplary manner in which the first displacement and the second displacement may be ascertained is provided below.

Figure 4:
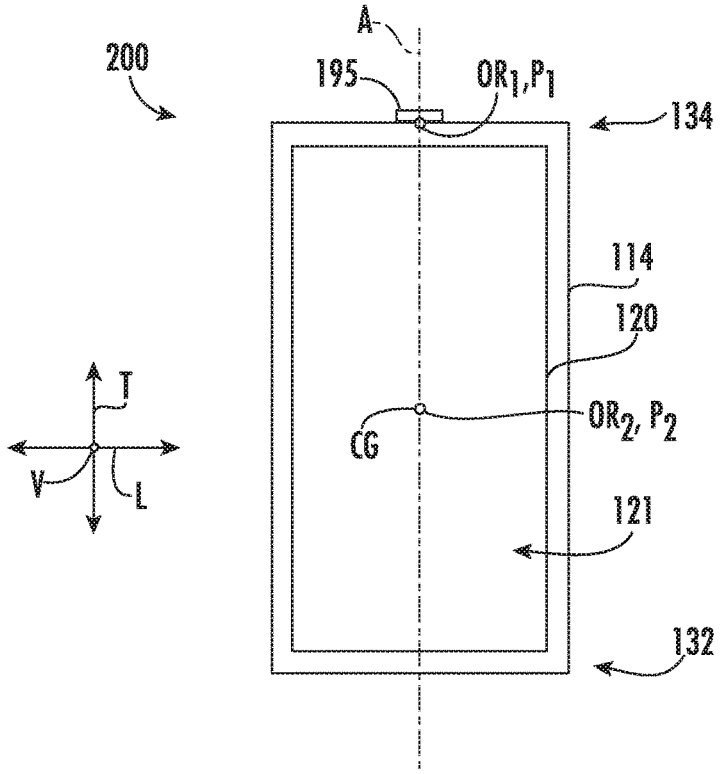
FIG. 4 provides a schematic, top plan view of an exemplary subwasher in a resting state according to an exemplary embodiment of the present disclosure.

FIG. 4 provides a schematic, top plan view of an exemplary subwasher 200 of washing machine appliance 100 of FIGS. 1 and 2 depicting subwasher 200 in its resting state according to an exemplary embodiment of the present disclosure. Subwasher 200 includes tub 114 and basket 120 rotatably mounted therein. As shown, tub 114 defines a first point P1 and a second point P2. Second point P2 is positioned forward of first point P1. More particularly, for this embodiment, first point P1 is defined at rear 134 of tub 114 and second point P2 is defined at a center of gravity CG of subwasher 200. Further, for this embodiment, first point P1 and second point P2 are positioned along the central axis A defined by shaft 136 (FIG. 2). In addition, as shown in FIG. 4, when subwasher 200 is in a resting state, first point P1 is positioned at a first origin OR1 and second point P2 is positioned at a second origin OR2. By positioning at least one of the points at or near the center of gravity of subwasher 200, calculation of the location of the imbalanced load may be more accurate for a wider variety of loads.

Figure 5:
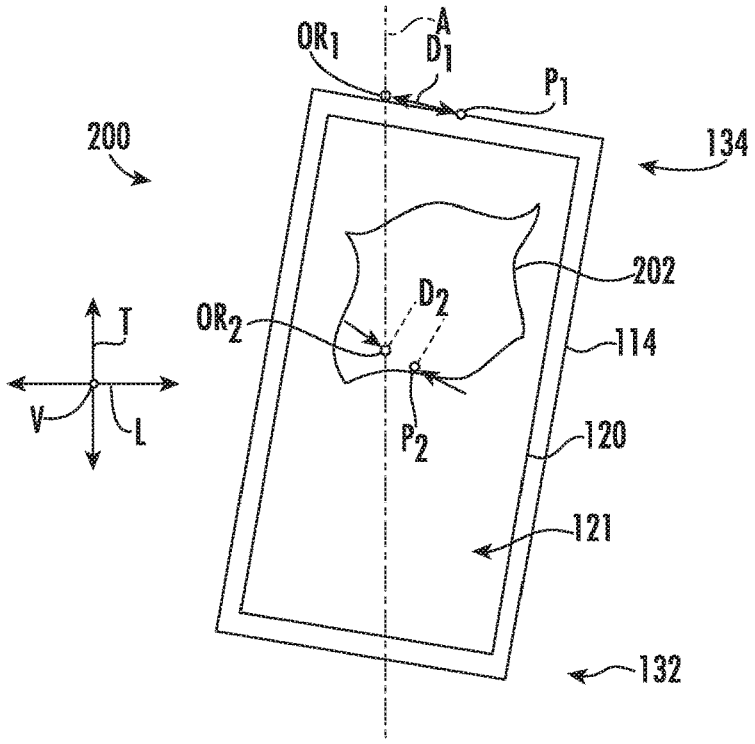
FIG. 5 provides a schematic, top plan view of the subwasher of FIG. 4 depicting a tub thereof displaced from its resting state position by an imbalanced load according to an exemplary embodiment of the present disclosure.

FIG. 5 provides a schematic, top plan view of subwasher 200 of FIG. 4 depicting tub 114 displaced from its resting state position by an imbalanced load 202 according to an exemplary embodiment of the present disclosure. As shown in FIG. 5, first point P1 is displaced from first origin OR1 and second point P2 is displaced from second origin OR2 by imbalanced load 202 located within basket 120. For this embodiment, as depicted, a first displacement D1 or distance between first point P1 and first origin OR1 caused by imbalanced load 202 is greater than a second displacement D2 or distance between second point P2 and second origin OR2. Stated differently, rear 134 of tub 114 is displaced from its resting state position a greater distance than the portion of tub 114 at or proximate the center of gravity CG of subwasher 200. In this context, "proximate" the center of gravity means within six (6) inches of the center of gravity.

At (302) and (304) (FIG. 3), the first and second displacements D1, D2 are ascertained.

For this exemplary embodiment, displacement measurement unit 195 is attached to tub 114 at first point P1 and is configured to sense or measure the first displacement D1, or the distance between first point P1 and first origin OR1. To ascertain first displacement D1, displacement measurement unit 195 provides input signals (e.g., a voltage or an acceleration reading generated by displacement measurement unit 195) to controller 180 indicative of the first displacement D1. In this way, first point P1 is a sensed or measured point. That is, first displacement D1 is sensed or measured by displacement measurement unit 195.

As further shown in FIGS. 4 and 5, for this exemplary embodiment, tub 114 of subwasher 200 does not include a displacement measurement unit at second point P2. Thus, to ascertain the second displacement D2, controller 180 estimates or predicts the displacement between second point P2 and second origin OR2, or second displacement D2. In this way, second point P2 is a virtual point. That is, assuming tub 114 is a rigid body and knowing the dimensional configuration of tub 114, the position of any point, including the second point P2, may be predicted based on the measured position of the first point P1. As the second displacement D2 is determined by using a virtual point at second point P2, washing machine appliance 100 need not include multiple displacement measurement units.

In alternative exemplary embodiments, the second point P2 may be a measured point and the first point P1 may be a virtual point. In yet other alternative exemplary embodiments, the first point P1 and the second point P2 may both be sensed or measured points. In such embodiments, washing machine appliance 100 may include two displacement measurement unit 195 positioned at the first and second points. In yet other embodiments, the first point P1 and the second point P2 may both be virtual points. In such embodiments, displacement measurement unit 195 may be attached to tub 114 at a given location, and the first displacement D1 of first point P1 relative to first origin OR1 and the second displacement D2 of second point P2 relative to second origin OR2 may be predicted.

Further, for this embodiment, the first displacement D1 is ascertained by taking or calculating the absolute value of the amplitudes of the displacement between first point P1 and first origin OR1 or the amplitude of a signal indicative of the first displacement for the first time period. In this way, the second displacement D2 of second point relative to second origin OR2 need not be calculated or predicted for every displacement value measured by displacement measurement unit 195. Rather, when controller 180 recognizes that the first displacement D1 has reached a maximum displacement for that particular oscillation (i.e., the displacement has reached its amplitude), the second displacement D2 can be calculated based at least in part on the absolute value of the amplitude of the first displacement for the first time period at that particular point in time. In this manner, the computational resources of controller 180 may be conserved.

Figure 6:
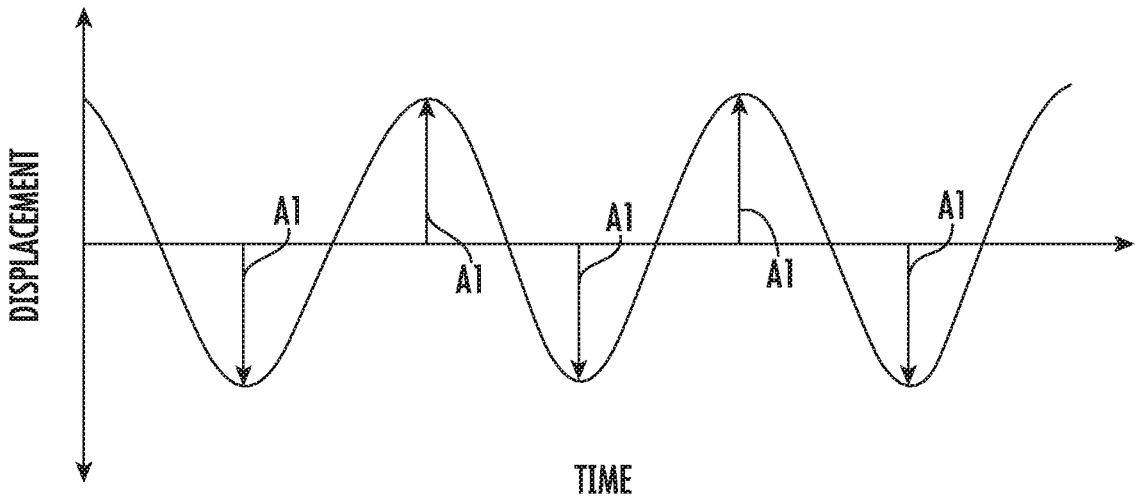
FIG. 6 provides an exemplary chart graphically depicting the displacement of a first point defined by a tub of a subwasher of a washing machine appliance relative to a first origin as a function of time according to an exemplary embodiment of the present disclosure.

FIG. 6 provides an exemplary chart graphically depicting the displacement of first point P1 relative to first origin OR1 as a function of time. As shown, as tub 114 oscillates back and forth during operation of washing machine appliance 100 due to imbalanced load 202 (FIG. 5), the signal generated by displacement measurement unit 195 indicative of the displacement of first point P1 relative to first origin OR1 oscillates back and forth in a sinusoidal wave. When controller 180 receives the input of raw displacement data from displacement measurement unit 195, controller 180 is configured to recognize the amplitudes A1 of the displacement or signal indicative of the displacement. Such amplitudes A1 may be stored for further use. For example, the amplitudes A1 of the displacement between the first point P1 and first origin OR1 may be used to calculate the amplitudes of the displacement between the second point P2 and second origin O2, as noted above. For instance, controller 180 may include a look up table that corresponds the amplitudes A1 of the displacement between first point P1 and first origin OR1 with amplitudes of the displacement between second point P2 and second origin O2. Once the amplitudes of the first and second displacements D1, D2 are ascertained, the amplitudes are compared such that the location of the imbalanced load may be determined.

Figure 7:
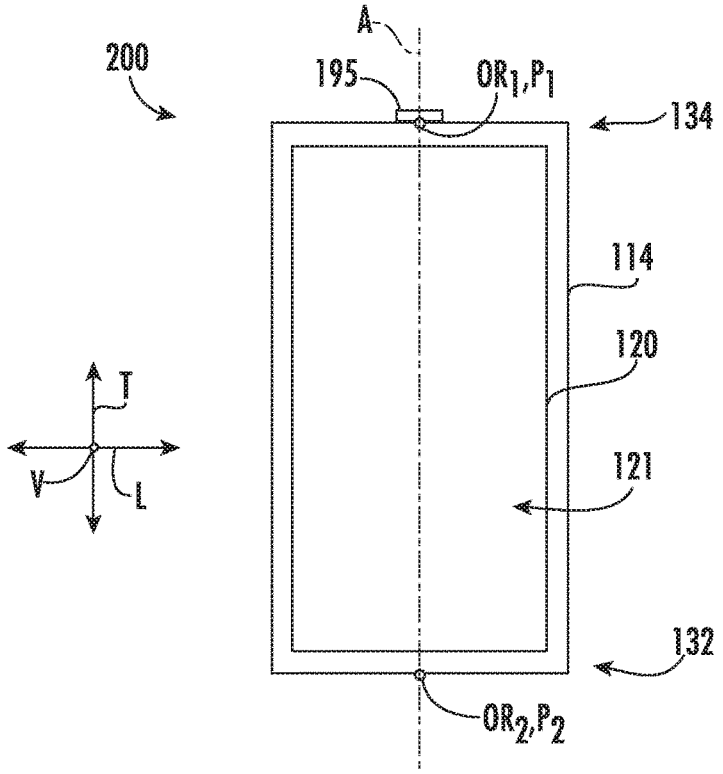
FIG. 7 provides a schematic, top plan view of an exemplary subwasher in a resting state according to an exemplary embodiment of the present disclosure.
Figure 8:
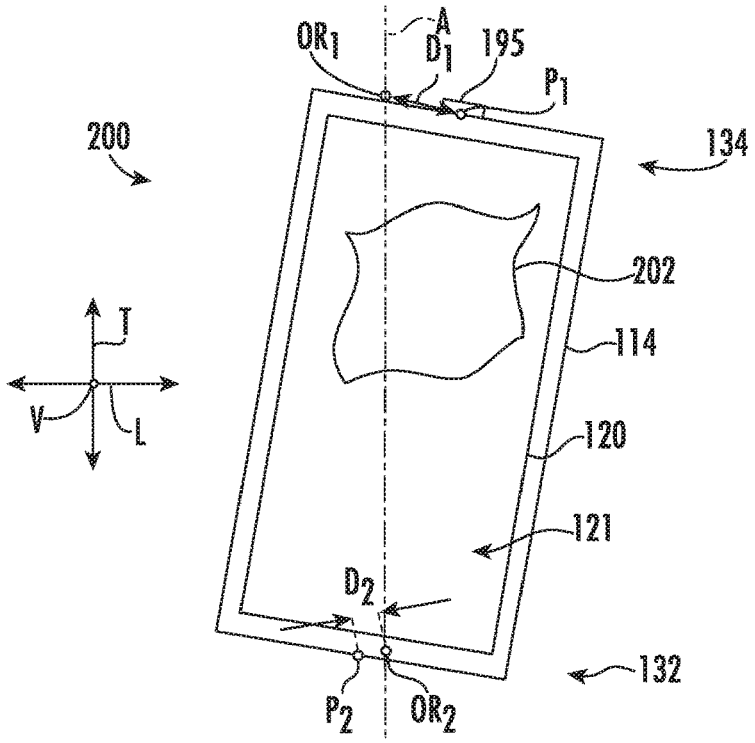
FIG. 8 provides a schematic, top plan view of the subwasher of FIG. 7 depicting a tub thereof displaced from its resting state position by an imbalanced load according to an exemplary embodiment of the present disclosure.
Figure 9:
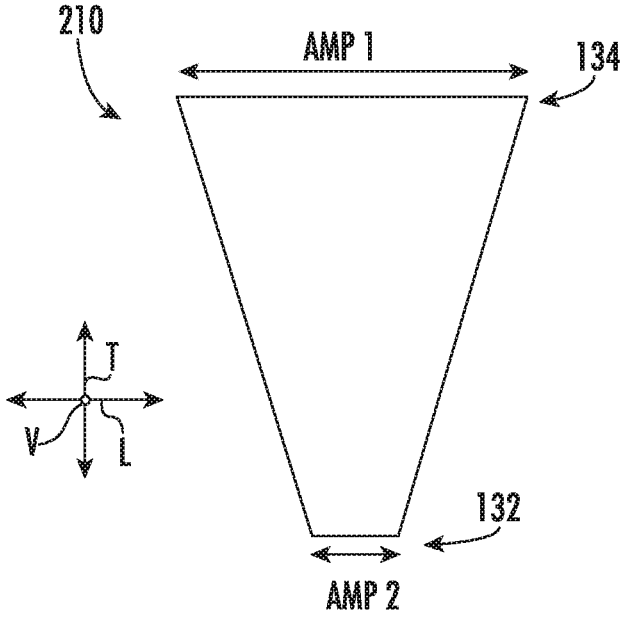
FIG. 9 provides a displacement envelope of a tub depicting a rear imbalanced load according to an exemplary embodiment of the present disclosure.
Figure 10:
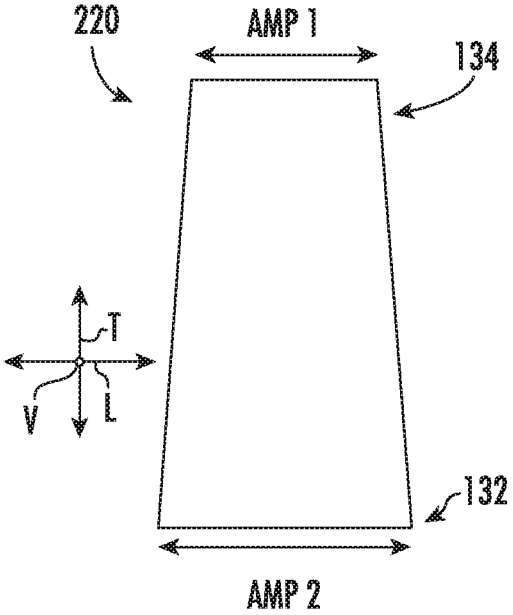
FIG. 10 provides a displacement envelope of a tub depicting a front imbalanced load according to an exemplary embodiment of the present disclosure.

In alternative exemplary embodiments, points P1 and P2 may be defined by tub 114 at different locations than as shown in FIGS. 4 and 5. For instance, as shown in FIGS. 7 and 8, first point P1 is defined at rear 134 of tub 114 and second point P2 is defined at front 132 of tub 114. Further, first point P1 and second point P2 are positioned along the central axis A defined by shaft 136 (FIG. 2), however, in alternative embodiments, one or both of first point P1 and second point P2 need not be positioned along the central axis A. In addition, as shown in FIG. 7, when subwasher 200 is in a resting state, first point P1 is positioned at a first origin OR1 and second point P2 is positioned at a second origin OR2. As shown in FIG. 8, tub 114 is displaced from its resting state position by imbalanced load 202. First point P1 is displaced from first origin OR1 and second point P2 is displaced from second origin OR2 by imbalanced load 202 located within basket 120. As depicted, first displacement D1 or distance between first point P1 and first origin OR1 caused by imbalanced load 202 is greater than second displacement D2 or distance between second point P2 and second origin OR2. Stated differently, rear 134 of tub 114 is displaced from its resting state position a greater distance than front 132 of tub 114.

At (306), with reference again to FIG. 3, method (300) includes determining the location of the imbalanced load based at least in part on the first displacement and the second displacement. The location of the imbalanced load may be determined utilizing the first displacement D1 determined at (302) and the second displacement D2 determined at (304) in a number of exemplary manners. Exemplary manners are provided below.

As one example, the location of the imbalanced load may be determined based at least in part on the first displacement and the second displacement by comparing the first displacement with the second displacement for the predetermined time period. More particularly, the amplitude of the first displacement D1 may be compared against the amplitude of the second displacement D2. If the amplitude of the first displacement D1 is greater than the amplitude of the second displacement D2, then the imbalanced load is located at a location of tub 114 that is towards the first point P1. In contrast, if the amplitude of the first displacement D1 is less than the amplitude of the second displacement D2, then the imbalanced load is located at a location of tub 114 that is towards the second point P2. If the amplitude of the first displacement D1 is equal to or about equal to the amplitude of the second displacement D2, then the imbalanced load is located approximately between the first and second points.

For instance, for implementations in which first point P1 is defined at rear 134 of tub 114 and second point P2 is defined at front 132 of tub 114, both points P1, P2 being aligned along the central axis A when subwasher 200 is positioned in the resting state, then if the amplitude of the first displacement D1 is greater than the amplitude of the second displacement D2, then the imbalanced load is located at a location towards rear 134 of tub 114 (i.e., towards first point P1). FIG. 7 depicts a displacement envelope 210 of tub 114 showing such a scenario. As shown in FIG. 7, the amplitude of the displacement of first point P1 relative to the first origin OR1, denoted as Amp 1, is greater than the amplitude of the displacement of second point P2 relative to the second origin OR2, denoted as Amp 2. Thus, the imbalanced load is determined to be located toward rear 134 of tub 114.

If, however, the amplitude of the first displacement D1 is less than the amplitude of the second displacement D2, then the imbalanced load is located at a location towards front 132 of tub 114 (i.e., towards second point P2). FIG. 8 depicts a displacement envelope 220 of tub 114 showing such a scenario. As shown in FIG. 8, the amplitude of the displacement of first point P1 relative to the first origin OR1, denoted as Amp 1, is less than the displacement of second point P2 relative to the second origin OR2, denoted as Amp 2, and thus, the imbalanced load is determined to be located toward front 132 of tub 114. Further, although not depicted, if the amplitude of the first displacement D1 is equal to or about equal to the amplitude of the second displacement D2, then the imbalanced load is located at a location approximately between front 132 and rear 134 of tub 114.

As another example, determining the location of the imbalanced load based at least in part on the first displacement and the second displacement includes determining a displacement ratio. For this embodiment, the displacement ratio is a ratio of the first displacement to the second displacement (D1:D2). However, in alternative exemplary embodiments, the displacement ratio is a ratio of the second displacement to the first displacement (D2:D1). For instance, for implementations in which first point P1 is defined at rear 134 of tub 114 and second point P2 is defined at front 132 of tub 114, both points P1, P2 being aligned along the central axis A when subwasher 200 is positioned in the resting state, then if the displacement ratio is greater than one (1), then the imbalanced load is located at a location towards rear 134 of tub 114 (i.e., towards first point P1). On the other hand, if the displacement ratio is less than one (1), then the imbalanced load is located at a location towards front 132 of tub 114 (i.e., towards second point P2). If the displacement ratio is equal to or about equal to one (1), then the imbalanced load is located at a location approximately between front 132 and rear 134 of tub 114.

In some implementations, method (300) includes comparing the displacement ratio to one or more displacement thresholds. Such displacement thresholds may provide additional resolution as to the location of the imbalanced load. As one example, controller 180 may be configured to classify the location of the imbalanced load as one of a front, front-middle, middle, rear middle, or rear location. Accordingly, the one or more displacement thresholds may include a first threshold delineating the front and front-middle locations, a second threshold delineating the front-middle and middle locations, a third threshold delineating the middle and rear-middle locations, and a fourth threshold delineating the rear-middle and rear locations within tub 114. Once the displacement ratio is known, the displacement ratio may systematically be compared to the displacement thresholds until the location of the imbalanced load is determined. It will be appreciated that controller 180 may also be configured to classify imbalanced locations with greater or fewer classifications than the example above.

The predetermined thresholds may change as a function of basket speed (i.e., the rpm of basket 120). Accordingly, in some implementations, method (300) includes plotting the displacement ratio as a function of basket speed and then comparing the displacement ratio to one or more displacement thresholds. By way of example, FIG. 11 graphically depicts the displacement ratio of three imbalanced loads plotted as a function of basket speed (rpm). The three imbalanced loads were run in separate wash cycles and the load size and load location were held constant. In particular, FIG. 11 graphically depicts the displacement ratio of a first imbalanced load L1 as a function of basket speed, a second imbalanced load L2 as a function of basket speed, and a third imbalanced load L3 as a function of basket speed. Further, for this embodiment, controller 180 is configured to classify the location of the imbalanced load as one of a front F, middle M, or rear R location. Accordingly, as shown, a first displacement threshold T1 delineates the front F and middle M locations and a second displacement threshold T2 delineates the middle M and rear R locations.

Figure 11:
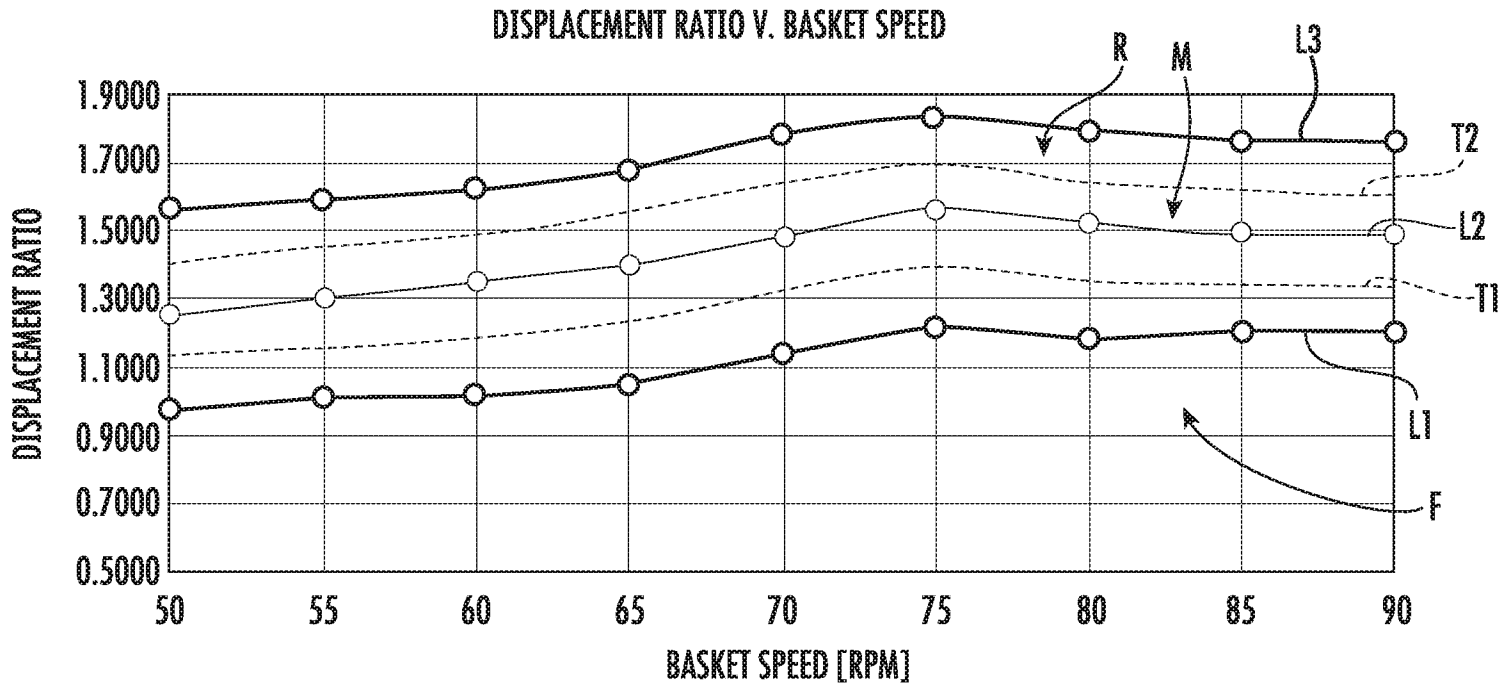
FIG. 11 provides a chart depicting the displacement ratio of three imbalanced loads plotted as a function of basket speed according to an exemplary embodiment of the present disclosure.

With reference still to FIG. 11, as shown, the displacement ratio of the first imbalanced load L1 is plotted as a function of basket speed. After being plotted, the displacement ratio of the first imbalanced load L1 is compared to one or more of the displacement thresholds. In particular, the displacement ratio of the first imbalanced load L1 is compared to the first displacement threshold T1. As the displacement ratio of the first imbalanced load L1 is less than the first threshold T1, the first imbalanced load L1 is determined to be located within the front F location (i.e., towards front 132 of tub 114).

Similarly, the displacement ratio of the second imbalanced load L2 is plotted as a function of basket speed. After being plotted, the displacement ratio of the second imbalanced load L2 is compared to one or more of the displacement thresholds. In particular, the displacement ratio of the second imbalanced load L2 is compared to the first displacement threshold T1, and it is determined that the displacement ratio of the second imbalanced load L2 is greater than the first threshold T1. The displacement ratio of the second imbalanced load L2 is then compared to the second displacement threshold T2, and it is determined that the displacement ratio of the second imbalanced load L2 is less than the second threshold T2. Thus, the second imbalanced load L2 is determined to be located within the middle location M or class (i.e., approximately at the middle of tub 114).

The displacement ratio of the third imbalanced load L3 is likewise plotted as a function of basket speed. After being plotted, the displacement ratio of the third imbalanced load L3 is compared to one or more of the displacement thresholds. In particular, the displacement ratio of the third imbalanced load L3 is compared to the first displacement threshold T1, and it is determined that the displacement ratio of the third imbalanced load L3 is greater than the first threshold T1. The displacement ratio of the third imbalanced load L3 is then compared to the second displacement threshold T2, and it is determined that the displacement ratio of the third imbalanced load L3 is greater than the second threshold T2. Thus, the third imbalanced load L3 is determined to be located within the rear location R or class (i.e., towards rear 134 of tub 114).

Notably, the displacement ratios of the imbalanced loads L1, L2, L3 change as basket speed increases while maintaining all other variables constant. Accordingly, the displacement thresholds can be set such that they account for the change in the displacement ratio as basket speed changes. This may provide further resolution as to the location of the imbalanced load within washing machine appliance 100 at various basket speeds. As will be appreciated, the displacement ratio may be plotted as a function of any characteristic that is indicative of basket speed. For example, the displacement ratio may alternatively be plotted against the power output of motor 128, basket acceleration, shaft speed of shaft 136, etc. Further, in some implementations, the displacement thresholds may remain static. In this way, computational resources are conserved and motor speed, basket speed, shaft speed, motor power output, etc. need not be taken into account to determine the location of an imbalanced load within washing machine appliance 100. Further, as the location of an imbalanced load may be determined without using motor speed, basket speed, shaft speed, motor power output, etc., it may be determined if a load of articles placed within basket 120 creates an out-of-balance load without rotating basket 120, which may conserve energy, among other potential benefits.

Further, in some implementations, based on the determined location of the imbalanced load, method (300) includes generating a control action in response to the location of the imbalanced load. As one example, if the imbalanced load is towards front 132 of tub 114, a current spin cycle being performed may be stopped, basket 120 may then be pulsed or otherwise rotated in a way to even out the load, and then wash basket 120 may be spun up once more to complete the spin cycle. Other control actions are also possible.

Figure 12:
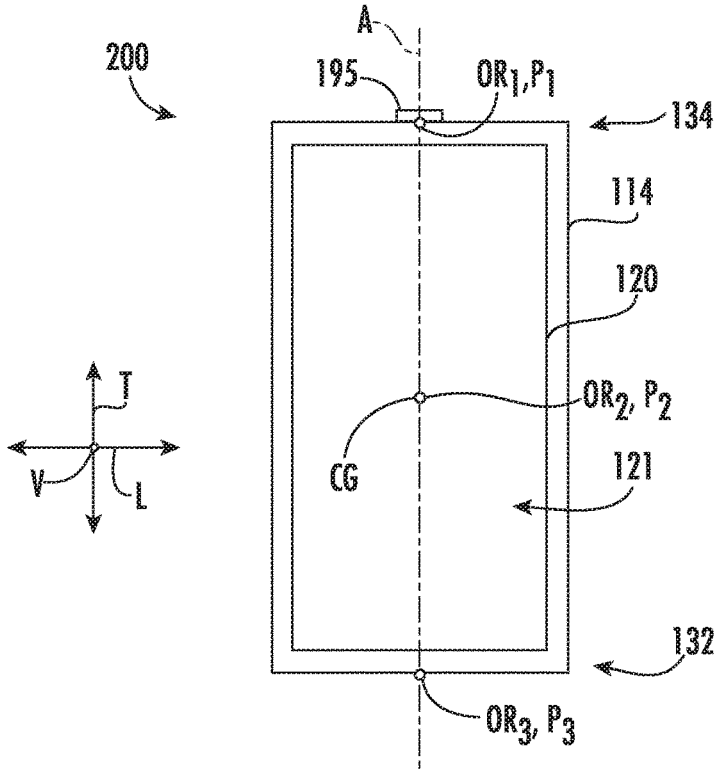
FIG. 12 provides a schematic, top plan view of an exemplary subwasher in a resting state according to an exemplary embodiment of the present disclosure.

In some exemplary implementations, the location of an imbalanced load for the first time period may be determined at (306) based at least in part on the first displacement, the second displacement, and a third displacement. In such implementations, method (300) includes ascertaining a third displacement of a third point relative to a third origin for the first time period. For instance, as shown in FIG. 12, subwasher 200 is depicted in its resting state according to an exemplary embodiment of the present disclosure. Subwasher 200 includes tub 114 and basket 120 rotatably mounted therein. As shown, tub 114 defines first point P1, second point P2, and a third point P3. Second point P2 is positioned forward of first point P1 and third point P3 is positioned forward of P2. In particular, for this embodiment, first point P1 is defined at rear 134 of tub 114, second point P2 is defined at a center of gravity CG of subwasher 200, and third point P3 is defined at front 132 of tub 114. Further, for this embodiment, first point P1, second point P2, and third point P3 are positioned along the central axis A defined by shaft 136 (FIG. 2). In addition, as shown in FIG. 12, when subwasher 200 is in a resting state, first point P1 is positioned at first origin OR1, second point P2 is positioned at second origin OR2, and third point P3 is positioned at a third origin OR3.

Figure 13:
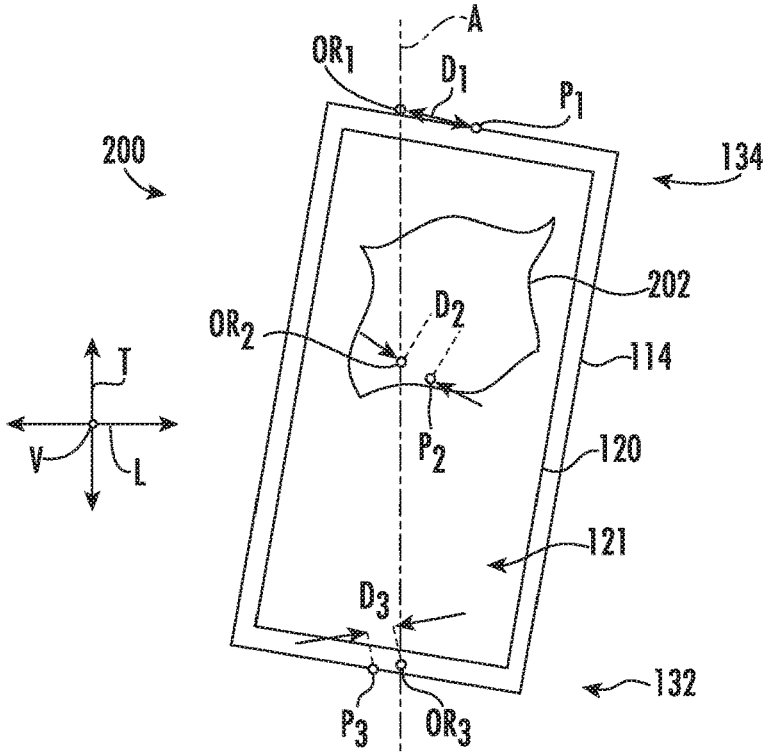
FIG. 13 provides a schematic, top plan view of the subwasher of FIG. 12 depicting a tub thereof displaced from its resting state position by an imbalanced load according to an exemplary embodiment of the present disclosure.

FIG. 13 provides a schematic, top plan view of subwasher 200 of FIG. 12 depicting tub 114 displaced from its resting state position by an imbalanced load 202 according to an exemplary embodiment of the present disclosure. As shown in FIG. 13, first point P1 is displaced from first origin OR1, second point P2 is displaced from second origin OR2, and third point P3 is displaced from third origin OR3 by imbalanced load 202 located within basket 120. For this embodiment, as depicted, first displacement D1 or distance between first point P1 and first origin OR1 caused by imbalanced load 202 is greater than second displacement D2 or distance between second point P2 and second origin OR2, and further, second displacement D2 is greater than a third displacement D3 or distance between third point P3 and third origin OR3.

Advantageously, by positioning points P1, P2, and P3 as noted above, various out-of-balance loading conditions may be distinguished. For instance, suppose in one case that a pure coupling of front 132 and rear 134 exists (i.e., the out-of-balance load at front 132 is equal to the out-of-balance load at rear 134 but with a rotation of one hundred eighty degrees (180°) of rotation), and suppose in another case that there is a middle out-of-balance load. By strictly utilizing the P1-P3 combination to detect the location of the imbalanced load, these two loads will look the same, that is the front motion will appear to equal the rear motion of tub 114. By using the P1-P2 combination, the loads will look differently. That is, by using P2, the difference between the middle out-of-balanced load and the pure coupling out-of-balanced load may be determined.

Figure 14:
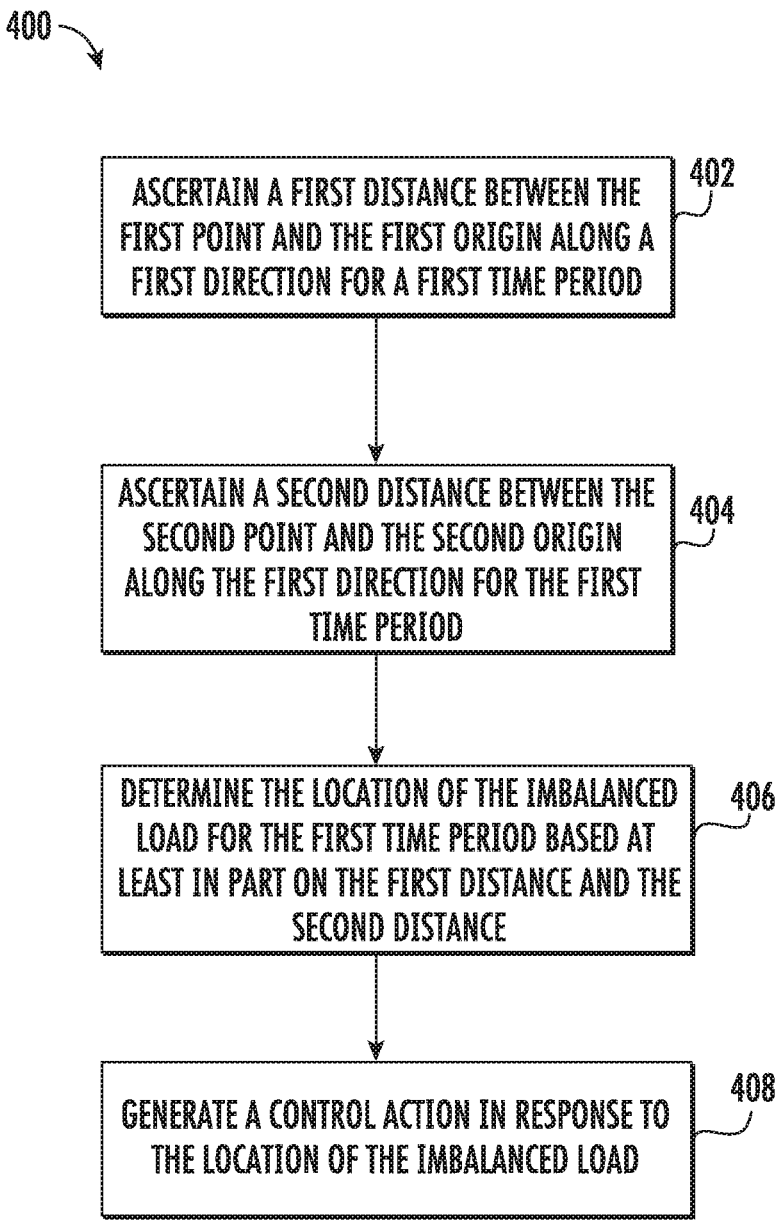
FIG. 14 provides a flow chart of another exemplary method for determining a location of an imbalanced load in a washing machine appliance according to an exemplary embodiment of the present disclosure.

FIG. 14 depicts an exemplary method (400) for determining a location of an imbalanced load in a washing machine appliance according to an exemplary embodiment of the present disclosure. Method (400) can be implemented using any suitable appliance, including for example, horizontal axis washing machine appliance 100 of FIGS. 1 and 2. Accordingly, to provide context to method (400), reference numerals utilized to describe the features of washing machine appliance 100 in FIGS. 1 and 2 will be used below.

In some exemplary implementations of method (400), washing machine appliance 100 extends between front 127 and rear 129 and includes tub 114 and basket 120 rotatably mounted within tub 114. Basket 120 is configured for receipt of articles for washing. Further, as will be explained further below, tub 114 defines a first point P1 and a second point P2. The second point P2 is positioned forward of the first point P1. For example, tub 114 may define the first point at a rear portion of tub 114 and tub 114 may define the second point at a front portion of tub 114. When washing machine appliance 100 is in a resting state (i.e., a state in which basket 120 is at rest without any articles within wash chamber 121 of basket 120), the first point is positioned at a first origin and the second point is positioned at a second origin. When washing machine appliance 100 is in an active state (i.e., there is a load within basket 120 and/or basket 120 is in motion), a first distance between the first point and the first origin along a first direction and a second distance between the second point and the second origin along the first direction are used to determine the relative motion of the tub at the first and second points, which in accordance with exemplary aspects of the present disclosure, may be used to determine the location of an imbalanced load within washing machine appliance 100.

At (402), method (400) includes ascertaining a first distance between the first point and the first origin along a first direction for a first time period. For instance, controller 180 may receive a signal generated by displacement measurement unit 195 indicative of the distance between the first point and the first origin along the first direction. For instance, a signal representative of the acceleration of the first point relative to the first origin along the first direction may be generated by displacement measurement unit 195. Upon receiving the signal, controller 180 may utilize the acceleration signal and a time step or other interval as the time parameter, and from these inputs, the distance between the first point and the first origin may be determined. Preferably, the first distance is determined as the maximum distance between the first point and the first origin during the first time period. The first direction may be any suitable direction. For example, the first direction may be a direction along the lateral direction L, along the transverse direction T, or along the vertical direction V.

At (404), method (400) includes ascertaining a second distance between the second point and the second origin along the first direction for the first time period. For instance, upon controller 180 ascertaining the first distance, the second distance may be predicted as will be explained further below. An exemplary manner in which the first distance and the second distance may be ascertained is provided below.

Figure 15:
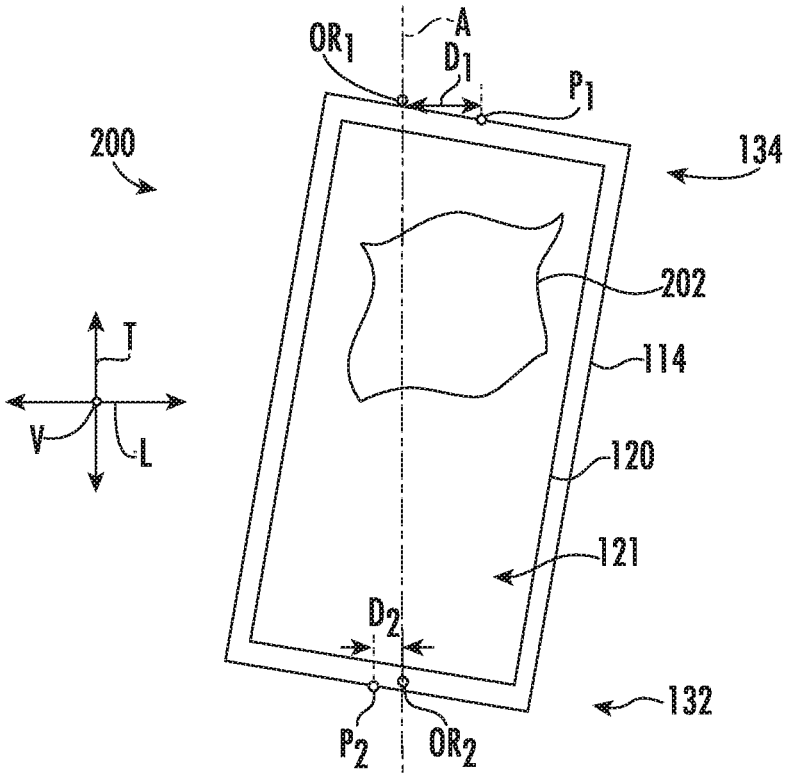
FIG. 15 provides a schematic, top plan view of a subwasher depicting a tub thereof displaced from its resting state position by an imbalanced load according to an exemplary embodiment of the present disclosure.

FIG. 15 provides a schematic, top plan view of subwasher 200 depicting tub 114 thereof displaced from its resting state position by an imbalanced load 202 according to an exemplary embodiment of the present disclosure. In this implementation, the first direction is a direction along the lateral direction L. As shown, the imbalanced load 202 located within basket 120 has caused the first point P1 to be spaced from first origin OR1 along the lateral direction L a first distance D1 and second point P2 to be spaced from second origin OR2 along the lateral direction L a second distance D2. For this embodiment, as depicted, the first distance D1 or distance between first point P1 and first origin OR1 along the first direction (e.g., the lateral direction L) is greater than the second distance D2 or distance between second point P2 and second origin OR2 along the first direction.

For the depicted embodiment of FIG. 15, displacement measurement unit 195 is attached to tub 114 at first point P1 and is configured to sense or measure the first distance D1, or the distance between first point P1 and first origin OR1 along the first direction. To ascertain first distance D1, displacement measurement unit 195 provides input signals (e.g., a voltage or an acceleration reading generated by displacement measurement unit 195) to controller 180 indicative of the first distance D1. In this way, first point P1 is a sensed or measured point. That is, first distance D1 is sensed or measured by displacement measurement unit 195.

As further shown in FIG. 15, for this exemplary embodiment, tub 114 of subwasher 200 does not include a displacement measurement unit at second point P2. Thus, to ascertain the second distance D2, controller 180 estimates or predicts the distance between second point P2 and second origin OR2. In this way, second point P2 is a virtual point. That is, assuming tub 114 is a rigid body and knowing the dimensional configuration of tub 114, the position of any point, including the second point P2, may be predicted based on the measured position of the first point P1. As the second distance D2 is determined by using a virtual point at second point P2, washing machine appliance 100 need not include multiple displacement measurement units.

In alternative exemplary embodiments, the second point P2 may be a measured point and the first point P1 may be a virtual point. In yet other alternative exemplary embodiments, the first point P1 and the second point P2 may both be sensed or measured points. In such embodiments, washing machine appliance 100 may include two displacement measurement unit 195 positioned at the first and second points. In yet other embodiments, the first point P1 and the second point P2 may both be virtual points. In such embodiments, displacement measurement unit 195 may be attached to tub 114 at a given location, and the first distance D1 and the second distance may be predicted.

Further, for this embodiment, the first distance D1 is ascertained by taking or calculating the absolute value of the amplitude of the distance between first point P1 and first origin OR1 along the first direction for the first time period. In this way, the second distance D2 need not be calculated or predicted for every distance value measured by displacement measurement unit 195. Rather, when controller 180 recognizes that the first point P1 has reached a maximum distance from first origin OR1 along the first direction for that particular oscillation (i.e., the distance has reached its amplitude), the second distance D2 can be calculated based at least in part on the absolute value of the amplitude of the first distance for the first time period at that particular point in time. In this manner, the computational resources of controller 180 may be conserved.

At (406), with reference again to FIG. 14, method (400) includes determining the location of the imbalanced load for the first time period based at least in part on the first distance and the second distance. As one example, determining the location of the imbalanced load for the first time period based at least in part on the first distance and the second distance includes determining a distance ratio. The distance ratio may either be a ratio of the second distance to the first distance (D2:D1) or a ratio of the first distance to the second distance (D1:D2). Thereafter, the distance ratio may be compared to one or more distance thresholds, e.g., in a like or similar manner as described above with respect to comparing the displacement ration to the displacement thresholds. Furthermore, the location of the imbalanced load may be determined in other suitable manners, such as e.g., any of the manners described above with respect to how the imbalanced load may be determined based at least in part on the first and second displacements.

At (408), method (400) includes generating a control action in response to the location of the imbalanced load. As one example, if the imbalanced load is towards front 132 of tub 114, a current spin cycle being performed may be stopped, basket 120 may then be pulsed or otherwise rotated in a way to even out the load, and then wash basket 120 may be spun up once more to complete the spin cycle. Other control actions are also possible.

In using method (400), components of the displacement vector (e.g., the distance between the points and their respective origins along the lateral direction, the distance between the points and their respective origins along the transverse direction, and/or the distance between the points and their respective origins along the vertical direction) may be used to determine the location of imbalanced loads within washing machine appliance 100. As a single component of the displacement vector (e.g., distance between the points and their respective origins along the lateral direction) may be used to determine the location of an imbalanced load, the number of computations needed to be performed by a processing device of controller 180 may be reduced, for example. That is, instead of potentially calculating the displacement of the points relative to their respective origins, which may include translational and rotational motion along all three (3) directions, in using method (400), motion need only be calculated for a single component of the displacement vector.

Further, in implementing method (400), more than two points may be used to determine the location of the imbalanced load for the first time period. For instance, in such implementations, method (400) includes ascertaining a third distance between a third point and a third origin along the first direction for the first time period. For instance, second point P2 may be positioned forward of first point P1 and third point P3 may be positioned forward of P2. For example, first point P1 may be defined at rear 134 of tub 114, second point P2 may be defined at a center of gravity CG of subwasher 200, and third point P3 may be defined at front 132 of tub 114. First point P1, second point P2, and third point P3 may be positioned along the central axis A defined by shaft 136 (FIG. 2). When subwasher 200 is in a resting state, first point P1 is positioned at first origin OR1, second point P2 is positioned at second origin OR2, and third point P3 is positioned at third origin OR3. Further, in such implementations, the method also includes determining the location of the imbalanced load for the first time period based at least in part on the first distance, the second distance, and the third distance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for determining a location of an imbalanced load in a washing machine appliance, the washing machine appliance extending between a front and a rear and comprising a tub and a basket rotatably mounted within the tub, the tub defining a first point and a second point positioned forward of the first point, the first point positioned at a first origin and the second point positioned at a second origin when the washing machine appliance is in a resting state, the method comprising:

ascertaining a first displacement of the first point relative to the first origin for a first time period;

ascertaining a second displacement of the second point relative to the second origin for the first time period; and determining the location of the imbalanced load for the first time period based at least in part on the first displacement and the second displacement, wherein determining the location of the imbalanced load for the first time period based at least in part on the first displacement and the second displacement comprises:

determining a displacement ratio, wherein the displacement ratio is either a ratio of the second displacement to the first displacement or a ratio of the first displacement to the second displacement;

plotting the displacement ratio as a function of the rotational speed of the basket;

comparing the displacement ratio to one or more displacement thresholds each determined as a function of the rotational speed of the basket over the first time period, wherein the first displacement is measured a plurality of times and the second displacement is measured a plurality of times over the first time period and wherein a rotational speed of the basket is increased over the first time period.

2. The method of claim 1, wherein the tub defines a third point positioned forward of the second point, the third point positioned at a third origin when the washing machine appliance is in the resting state, the method further comprising:

ascertaining a third displacement of the third point relative to the third origin for the first time period;

wherein during determining the location of the imbalanced load for the first time period, the location is determined based at least in part on the first displacement, the second displacement, and the third displacement.

3. The method of claim 2, wherein the horizontal axis washing machine appliance comprises a shaft defining a central axis about which the basket is rotatable, and wherein the first point and the second point are positioned along the central axis when the horizontal axis washing machine appliance is in the resting state.

4. The method of claim 1, wherein the tub extends between a front and a rear, and wherein the first point is defined at or proximate the rear of the tub and the second point is defined at or proximate the front of the tub.

5. The method of claim 4, wherein determining the location of the imbalanced load for the first time period based at least in part on the first displacement and the second displacement comprises comparing the first displacement with the second displacement, and wherein if the first displacement is greater than the second displacement, then the imbalanced load is located towards the rear of the tub.

6. The method of claim 4, wherein determining the location of the imbalanced load for the first time period based at least in part on the first displacement and the second displacement comprises comparing the first displacement with the second displacement, and wherein if the first displacement is less than the second displacement, then the imbalanced load is located towards the front of the tub.

7. The method of claim 1, wherein the tub extends between a front and a rear and the tub defines a center of gravity, and wherein the first point is defined by the tub at or proximate the rear of the tub and the second point is defined by the tub at or proximate the center of gravity of the tub.

8. The method of claim 1, wherein ascertaining the first displacement comprises calculating an absolute value of an amplitude of the first displacement for the first time period and wherein ascertaining the second displacement comprises calculating the second displacement for the first time period based at least in part on the absolute value of the amplitude of the first displacement for the first time period.

9. A horizontal axis washing machine appliance, comprising:

a cabinet;

a tub positioned within the cabinet and extending between a front and a rear, the tub defining a first point and a second point positioned forward of the first point, the first point positioned at a first origin and the second point positioned at a second origin when the horizontal axis washing machine appliance is in a resting state;

a basket rotatably mounted within the tub, the basket defining a wash chamber for receipt of articles for washing;

a displacement measurement unit attached to the tub; and a controller in operative communication with the displacement measurement unit and configured to:

receive an input generated by the displacement measurement unit that is indicative of a displacement of the tub relative to its position in the resting state for a first time period;

ascertain a first displacement of the first point relative to the first origin for the first time period based at least in part on the input;

ascertain a second displacement of the second point relative to the second origin for the first time period based at least in part on the input;

determine a location of an imbalanced load for the first time period based at least in part on the first displacement and the second displacement, wherein the first displacement is measured a plurality of times and the second displacement is measured a plurality of times over the first time period and wherein a rotational speed of the basket is increased over the first time period, and wherein in determining the location of the imbalanced load for the first time period based at least in part on the first displacement and the second displacement, the controller is configured to:

determine a displacement ratio, wherein the displacement ratio is either a ratio of the second displacement to the first displacement or a ratio of the first displacement to the second displacement;

plot the displacement ratio as a function of the rotational speed of the basket; and compare the displacement ratio to one or more displacement thresholds each determined as a function of the rotational speed of the basket over the first time period; and generate a control action in response to the location of the imbalanced load.

10. The washing machine appliance of claim 9, wherein the displacement measurement unit comprises an accelerometer and a gyroscope.

11. The washing machine appliance of claim 9, further comprising:

a motor in mechanical communication with the basket, the motor configured for selectively rotating the basket within the tub; and a shaft mechanically coupling the motor with the basket and defining a central axis, and wherein the first point and the second point are positioned along the central axis when the horizontal axis washing machine appliance is in the resting state.

12. The washing machine appliance of claim 9, wherein the tub extends between a front and a rear, and wherein the first point is defined at or proximate the front of the tub and the second point is defined at or proximate the rear of the tub.

13. The washing machine appliance of claim 9, wherein the first displacement is measured by the displacement measurement unit and the second displacement is predicted based at least in part on the first displacement.

14. The washing machine appliance of claim 9, wherein the first displacement is ascertained by taking an absolute value of an amplitude of a signal indicative of the first displacement for the first time period and wherein the second displacement is ascertained based at least in part on the absolute value of the amplitude of the first displacement for the first time period.

15. A method for determining a location of an imbalanced load in a washing machine appliance, the washing machine appliance extending between a front and a rear and comprising a tub and a basket rotatably mounted within the tub, the tub defining a first point and a second point positioned forward of the first point, the first point positioned at a first origin and the second point positioned at a second origin when the washing machine appliance is in a resting state, the method comprising:

ascertaining a first distance between the first point and the first origin along a first direction for a first time period;

ascertaining a second distance between the second point and the second origin along the first direction for the first time period;

determining the location of the imbalanced load for the first time period based at least in part on the first distance and the second distance; and generating a control action in response to the location of the imbalanced load, wherein the first distance is measured via a displacement measurement unit attached to the tub, and the second distance is ascertained via a prediction based on the measured first distance.

16. The method of claim 15, wherein determining the location of the imbalanced load for the first time period based at least in part on the first distance and the second distance comprises:

determining a distance ratio, wherein the distance ratio is either a ratio of the second distance to the first distance or a ratio of the first distance to the second distance; and comparing the distance ratio to one or more distance thresholds.

* * * * *